US009237785B2

(12) United States Patent
Ma

(10) Patent No.: US 9,237,785 B2
(45) Date of Patent: Jan. 19, 2016

(54) CANTILEVER UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 101 days.

(21) Appl. No.: 13/797,156

(22) Filed: Mar. 12, 2013

(65) Prior Publication Data

US 2014/0230867 A1 Aug. 21, 2014

Related U.S. Application Data

(60) Provisional application No. 61/766,640, filed on Feb. 19, 2013.

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2023/0012* (2013.01); *A45B 2023/0043* (2013.01); *A45B 2023/0081* (2013.01)

(58) Field of Classification Search
CPC ..... A45B 17/00; A45B 2023/0037; A45B 2023/0081
USPC ..... 135/20.1, 20.3, 21, 74
See application file for complete search history.

(56) References Cited

U.S. PATENT DOCUMENTS 2,183,833 A 12/1939 Farhar
2,235,518 A 3/1941 Goshaw
2,475,406 A 7/1949 Russell
2,661,752 A 12/1953 Kampf et al.
2,670,133 A 2/1954 Volker
2,721,569 A 10/1955 Militano
2,724,396 A 11/1955 Pereira
2,905,187 A 9/1959 Croce
2,914,154 A 11/1959 Russell
3,120,238 A 2/1964 Glatz
3,129,715 A 4/1964 Fleischer et al.
3,142,307 A 7/1964 Danciart et al.
3,145,720 A 8/1964 Torii
3,150,671 A 9/1964 Frey
3,175,568 A 3/1965 Kafka
3,182,673 A 5/1965 Small
3,486,514 A 12/1969 Prescott
3,765,434 A 10/1973 Riggs (Continued)

FOREIGN PATENT DOCUMENTS

CN 2419864 Y 2/2001
CN 2441342 Y 8/2001

(Continued)

OTHER PUBLICATIONS

U.S. Appl. No. 13/802,238, filed Mar. 12, 2013, Ma, and its prosecution history.

(Continued)

*Primary Examiner* — Noah Chandler Hawk
(74) *Attorney, Agent, or Firm* — Knobbe Martens Olson & Bear, LLP

(57) ABSTRACT

Umbrella assemblies described herein are configured to retract and extend, tilt side to side, and open and close. In some embodiments, the umbrella assembly can include a cantilevered beam. The umbrella assembly can further include a tilt mechanism operable to rotate the canopy frame. The umbrella assembly can include a clutch mechanism fixed to the cantilevered beam.

19 Claims, 17 Drawing Sheets

(56) References Cited

U.S. PATENT DOCUMENTS

| | | | | |
|---|---|---|---|---|
| 3,926,202 | A | 12/1975 | Uthemann et al. | |
| 4,148,164 | A | 4/1979 | Humphrey | |
| 4,582,078 | A | 4/1986 | Ma | |
| 4,586,525 | A | 5/1986 | Glatz et al. | |
| 4,606,366 | A | 8/1986 | Collet | |
| 4,622,987 | A | 11/1986 | Redl et al. | |
| 4,674,523 | A | 6/1987 | Glatz | |
| 4,697,606 | A | 10/1987 | Ma | |
| 4,878,509 | A | 11/1989 | Tung | |
| 5,002,081 | A | 3/1991 | Stromeyers | |
| 5,029,596 | A | 7/1991 | Tung | |
| 5,086,797 | A | 2/1992 | Earnshaw et al. | |
| 5,116,258 | A | 5/1992 | Vennik | |
| 5,156,395 | A | 10/1992 | Smith | |
| 5,161,764 | A | 11/1992 | Roney | |
| 5,349,975 | A | 9/1994 | Valdner | |
| 5,437,297 | A | 8/1995 | Crisman et al. | |
| 5,492,232 | A | 2/1996 | Ohm | |
| 5,499,644 | A | 3/1996 | Geniele | |
| 5,584,564 | A | 12/1996 | Phyle | |
| 5,611,364 | A | 3/1997 | Woods et al. | |
| 5,678,585 | A | 10/1997 | May | |
| 5,711,333 | A | 1/1998 | Vanderminden, Sr. | |
| 5,735,302 | A | 4/1998 | Saliva | |
| 5,785,069 | A | 7/1998 | Glatz | |
| D398,443 | S | 9/1998 | Bolle | |
| 5,845,665 | A | 12/1998 | Koehn | |
| 5,868,152 | A | 2/1999 | Brown | |
| 5,871,024 | A | 2/1999 | Vanderminden, Sr. | |
| 5,937,882 | A | 8/1999 | Harbaugh | |
| 5,960,806 | A | 10/1999 | Steiner | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,209,147 | B1 | 4/2001 | Wheaton | |
| 6,220,261 | B1 | 4/2001 | Glatz | |
| 6,311,705 | B1 | 11/2001 | Ma | |
| 6,321,763 | B1 | 11/2001 | Ma | |
| 6,330,886 | B1 | 12/2001 | Culver | |
| 6,435,444 | B1 | 8/2002 | Lin | |
| 6,446,650 | B1 | 9/2002 | Ma | |
| 6,478,037 | B2 | 11/2002 | Tung | |
| 6,520,192 | B1 | 2/2003 | Lo | |
| 6,571,403 | B2 | 6/2003 | Wheaton | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,607,002 | B2 | 8/2003 | Reese | |
| 6,619,306 | B2 | 9/2003 | Ma | |
| 6,662,815 | B2 | 12/2003 | Tung | |
| 6,761,180 | B1 | 7/2004 | Lai | |
| D497,479 | S | 10/2004 | Yu | |
| 6,827,094 | B1 | 12/2004 | Bramwells | |
| 6,837,255 | B2 | 1/2005 | Bunch et al. | |
| 6,840,253 | B2 | 1/2005 | Ma | |
| 6,851,823 | B2 | 2/2005 | Bilotti | |
| 6,923,193 | B2 | 8/2005 | Chen | |
| 6,926,019 | B2 | 8/2005 | Glatz | |
| 6,945,263 | B2 | 9/2005 | Li | |
| 6,953,043 | B2 | 10/2005 | Yu | |
| 6,988,504 | B1 | 1/2006 | Goldwitz | |
| D518,629 | S | 4/2006 | Ma | |
| 7,108,388 | B2 | 9/2006 | Li | |
| 7,134,442 | B2 | 11/2006 | Ma | |
| 7,156,114 | B2 | 1/2007 | Lo | |
| 7,207,343 | B2 | 4/2007 | Earnshaw et al. | |
| 7,255,118 | B2 | 8/2007 | Vardy et al. | |
| 7,341,068 | B2 | 3/2008 | Liu | |
| 7,398,790 | B2 | 7/2008 | Glatz | |
| 7,412,985 | B2 | 8/2008 | Ma | |
| 7,493,909 | B2 | 2/2009 | Ma | |
| 7,520,289 | B1 * | 4/2009 | Barber | 135/21 |
| 7,533,680 | B2 | 5/2009 | Ma | |
| 7,556,051 | B2 | 7/2009 | Lai | |
| 7,708,022 | B2 | 5/2010 | Ma | |
| 7,717,121 | B2 * | 5/2010 | Glatz | 135/21 |
| D621,600 | S | 8/2010 | He | |
| 7,866,331 | B2 | 1/2011 | Glatz | |
| 7,886,755 | B2 | 2/2011 | Tung | |
| 7,913,707 | B2 * | 3/2011 | Lai | 135/21 |
| 7,918,054 | B2 | 4/2011 | Grafton | |
| D638,622 | S | 5/2011 | He | |
| 7,980,261 | B2 | 7/2011 | Glatz | |
| 8,066,021 | B2 | 11/2011 | Ma | |
| 8,104,492 | B2 | 1/2012 | Dan | |
| 8,113,223 | B2 | 2/2012 | Wang et al. | |
| 8,360,080 | B2 | 1/2013 | Liu et al. | |
| 8,522,804 | B1 | 9/2013 | Tung | |
| 2002/0083969 | A1 | 7/2002 | Tung | |
| 2002/0104557 | A1 | 8/2002 | Tung | |
| 2002/0129847 | A1 | 9/2002 | Ma | |
| 2002/0174887 | A1 | 11/2002 | Reese | |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0177871 | A1 | 9/2004 | Harbaugh | |
| 2004/0182429 | A1 | 9/2004 | Chen | |
| 2004/0261827 | A1 | 12/2004 | Chen | |
| 2005/0013130 | A1 | 1/2005 | Li | |
| 2005/0016571 | A1 | 1/2005 | Wu | |
| 2005/0028852 | A1 | 2/2005 | Reese | |
| 2005/0041425 | A1 | 2/2005 | Li | |
| 2005/0183762 | A1 | 8/2005 | Ma | |
| 2005/0229957 | A1 | 10/2005 | Glatz | |
| 2005/0268952 | A1 | 12/2005 | Ma | |
| 2005/0268953 | A1 | 12/2005 | Ma | |
| 2006/0081277 | A1 | 4/2006 | Liu | |
| 2006/0169307 | A1 | 8/2006 | Lo | |
| 2006/0201542 | A1 | 9/2006 | Ma | |
| 2006/0243311 | A1 | 11/2006 | Glatz | |
| 2006/0278262 | A1 | 12/2006 | Ma | |
| 2007/0074751 | A1 | 4/2007 | Fraser | |
| 2007/0163632 | A1 | 7/2007 | Chang | |
| 2007/0209688 | A1 | 9/2007 | Earnshaw | |
| 2010/0051074 | A1 | 3/2010 | Dan | |
| 2010/0101614 | A1 | 4/2010 | Wang et al. | |
| 2010/0192997 | A1 | 8/2010 | Liu et al. | |
| 2010/0212705 | A1 | 8/2010 | Tung | |
| 2011/0005558 | A1 | 1/2011 | Lai | |
| 2013/0092200 | A1 | 4/2013 | May | |
| 2013/0333734 | A1 * | 12/2013 | Ma | 135/20.1 |
| 2014/0158173 | A1 | 6/2014 | Li et al. | |
| 2014/0166060 | A1 | 6/2014 | Ma | |
| 2014/0311537 | A1 | 10/2014 | Ma | |
| 2015/0059815 | A1 | 3/2015 | Xiong | |

FOREIGN PATENT DOCUMENTS

| | | | |
|---|---|---|---|
| CN | 2621472 | Y | 6/2004 |
| CN | 2843147 | Y | 12/2006 |
| CN | 2896981 | | 5/2007 |
| CN | 201001460 | Y | 1/2008 |
| CN | 201001463 | Y | 1/2008 |
| CN | 201076109 | Y | 6/2008 |
| CN | 201135192 | Y | 10/2008 |
| CN | 201197439 | Y | 2/2009 |
| CN | 201207982 | Y | 3/2009 |
| DE | 580503 | | 7/1933 |
| DE | 2259192 | | 6/1974 |
| DE | 3229776 | | 4/1983 |
| DE | 3820573 | | 8/1989 |
| DE | 297 12 024 | | 9/1997 |
| DE | 299 06 116 | | 8/1999 |
| DE | 20205561 | | 7/2002 |
| DE | 10 2008 034 985 | | 2/2010 |
| EP | 0 392 989 | | 10/1990 |
| EP | 1 400 186 | | 3/2004 |
| EP | 1 700 536 | | 9/2006 |
| EP | 2 103 230 | | 9/2009 |

(56) References Cited

FOREIGN PATENT DOCUMENTS

| | | |
|---|---|---|
| EP | 2 425 738 | 3/2012 |
| GB | 22218 | 9/1911 |
| WO | WO 97/04682 | 2/1997 |
| WO | WO 00/55456 | 9/2000 |
| WO | WO 2005/018369 | 3/2005 |

OTHER PUBLICATIONS

Operation Manual Easy Sun Parasol Sunshade (Issue: Jul. 2004) pp. 1-17.

Treasure Garden's product brochure identified as "AG3 9' Centilever Umbrella", p. 2.

Extended European Search Report issued in European Patent Application No. 14155827.0, dated Apr. 29, 2014, in 6 pages.

Extended European Search Report issued in European Patent Application No. 14183987.8, dated Oct. 15, 2014, in 6 pages.

Extended European Search Report issued in European Patent Application No. 14183979.5, dated Oct. 16, 2014, in 6 pages.

Extended European Search Report issued in European Patent Application No. 14185661.7, dated Feb. 4, 2015, in 8 pages.

Activa Leisure, 2010 Product Catalog.

Treasure Garden, 2010 Product Catalog.

* cited by examiner

CANTILEVER UMBRELLA

INCORPORATION BY REFERENCE TO ANY PRIORITY APPLICATIONS

Any and all applications for which a foreign or domestic priority claim is identified in the Application Data Sheet as filed with the present application, including U.S. 61/766,640, are hereby incorporated by reference under 37 CFR 1.57.

BACKGROUND OF THE INVENTION

1. Field of the Invention

This application is directed to a cantilever umbrella that can retract and extend, and that also can tilt laterally from side to side to provide flexible positioning of the shade provided thereby.

2. Description of the Related Art

Umbrellas generally have a support pole centrally located directly beneath the canopy. This construction has several disadvantages. For example, the pole is located at the most sheltered position under the canopy. Also, the pole obstructs the view of persons seated beneath the canopy. Some umbrella designs locate the support pole to the side of the canopy, generally suspending the canopy from above. A disadvantage of these designs is that they are larger, taking up more space than umbrellas supported from below. A few umbrella designs support a canopy from above and are retractable to reduce the amount of space that they require.

Often times, umbrellas provide shade that is optimal during some times of the day when the sun is directly overhead, but less so when the sun is not directly overhead. Therefore, some umbrella designs provide for tilting of the shade providing portion, or canopy. Although this function is very useful, it becomes difficult to keep the umbrella compact while providing all the functions of retractability, tiltability, and the ability to open and close the canopy frame.

SUMMARY OF THE INVENTION

For all the reasons set forth above, new umbrella designs are needed that are retractable and extendable, that can be tilted from side to side to adjust the shade that is provided, and that can open and close to facilitate storage when shade is not needed. It is preferred that such functions be provided in a compact arrangement to keep the weight and cost of the umbrella down and also to keep the umbrella compact.

In one embodiment, an umbrella assembly is provided that includes a canopy assembly comprising a shade structure and a frame having an upper portion disposed below the shade structure. The frame also includes a lower portion disposed below and supporting the upper portion. The umbrella assembly also includes a support pole having an upper portion and a lower portion configured to be supported in an upright position by a base. The umbrella assembly also includes a collar coupled with the upper portion of the support pole. The umbrella assembly also includes a cantilevered beam having a first end disposed below the shade structure and coupled with the frame. The cantilevered beam also includes a second end disposed adjacent to the support pole when the umbrella assembly is in an open position. The cantilevered beam extends through the collar. The umbrella assembly also includes a latch mechanism coupled with the collar. The collar includes a first configuration that permits the cantilevered beam to be translated through the collar toward and away from the open position. The collar also includes a second configuration in which the cantilevered beam is prevented from being translated through the collar toward and away from the open position. The umbrella assembly also includes a tilt mechanism disposed at the second end of the cantilever beam. The tilt mechanism is capable of being actuated at the second end of the cantilever beam to rotate the canopy assembly remotely at the first end. The umbrella assembly also includes a clutch mechanism. The clutch mechanism includes a locking device disposed within and adjacent to the first end of the cantilevered beam and an actuator disposed adjacent to the second end of the cantilevered beam. The umbrella assembly also includes a cable having a first end coupled with the collar and a second end coupled with the lower portion of the frame. A mid portion of the cable is disposed above the cantilever beam. The cable has a fixed length such that as the cantilevered beam is extended within the collar to the open position, the cable applies an upward force to the lower portion of the frame to raise the lower portion of the frame. When the cantilevered beam is fully extended and the latch is in the second configuration preventing the cantilevered beam from moving away from the open position, the cable is tensioned keeping the canopy assembly fully open.

In another embodiment, an umbrella assembly is provided that includes an upright pole and a cantilevered beam. The cantilevered beam includes a connected end coupled to the upright pole and a free end translatable outward away from the pole. The umbrella assembly also includes a canopy frame coupled with the free end of the cantilevered beam. The umbrella assembly also includes a tilt mechanism operable from the connected end to rotate the free end and the canopy about an axis extending through the cantilevered beam. The umbrella assembly also includes a fixed length cable that is tensioned as the cantilevered beam is translated outward, the tensioning causing the canopy frame to open.

In another embodiment, a canopy frame includes, an upper portion having an upper hub with a plurality of ribs extending outwardly thereof. The canopy frame also includes a lower portion comprising a lower hub having a plurality of struts extending upwardly to the ribs. The canopy frame also includes a first pole portion extending downwardly from the upper hub and a second pole portion extending upwardly from the lower hub.

In some embodiments, the cable is coupled with the lower hub and extends within the first and second pole portions. In some embodiments, the umbrella assembly includes an elbow having a first portion coupled with the free end of the cantilevered beam and a second portion pivotally coupled with the first pole portion.

In some embodiments, the second portion of the elbow includes a semicircular sleeve configured to mate with the first pole portion when the canopy frame is open. In some embodiments, the second portion of the elbow comprises a semicircular recess configured to mate with the first pole portion when the canopy frame is closed.

In some embodiments the umbrella assembly includes a collar coupled with the upper portion of the upright pole. The collar is configured to permit the cantilevered beam to slide therein inward and outward. In some embodiments, the umbrella assembly includes a latch mechanism coupled with the collar having a first configuration that permits the cantilevered beam to be translated through the collar to open and close the canopy frame.

In some embodiments, the tilt mechanism includes a worm gear engaged with a drive shaft disposed in the cantilever beam. The drive shaft is configured to be coupled with the canopy frame by a disengageable drive mechanism. In some embodiments, the disengageable drive mechanism includes a lever disposed at the connected end of the cantilevered beam and a cable disposed within the draft shaft within the cantilevered beam.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Figure 1:
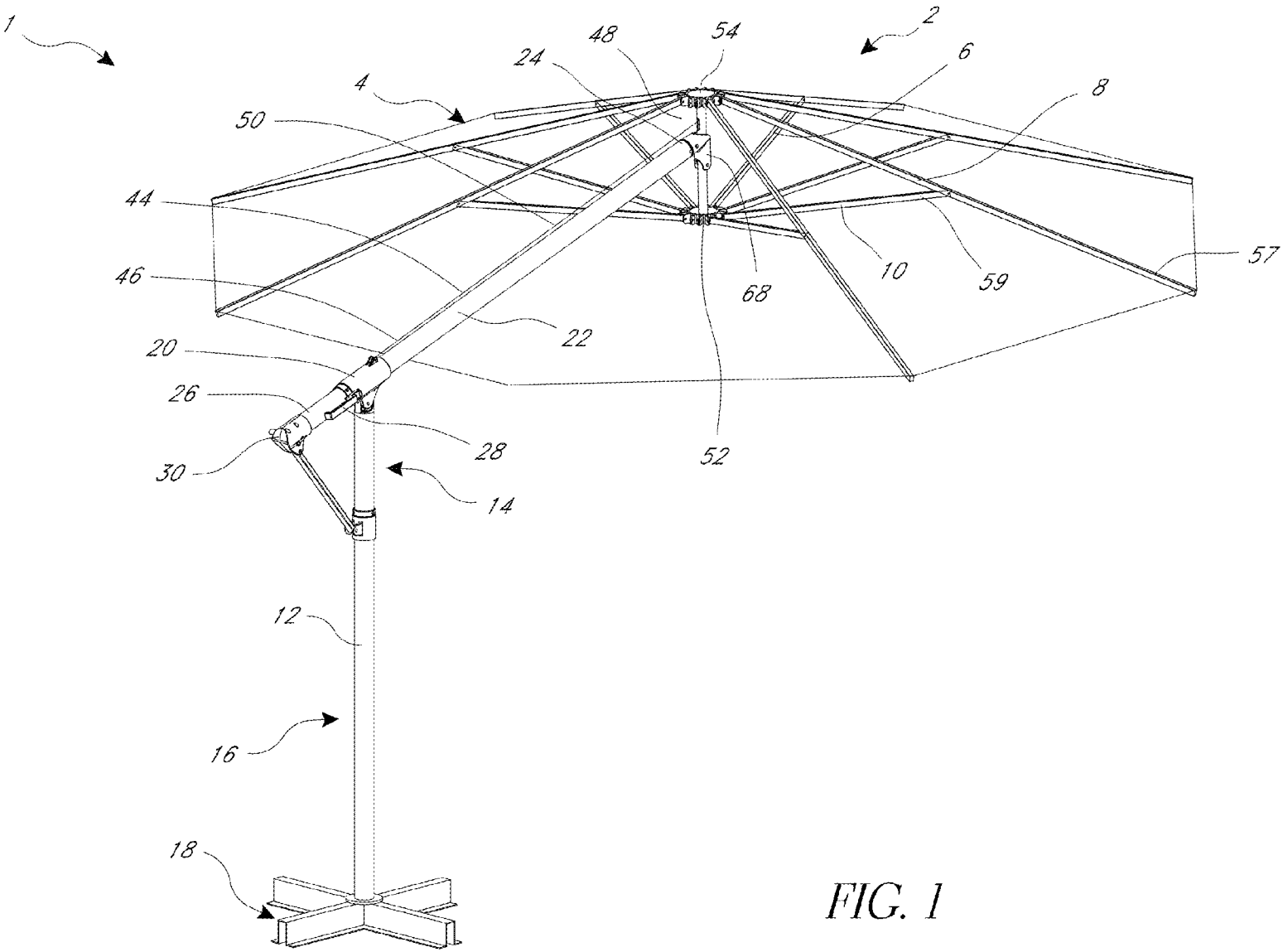
FIG. 1 is a perspective view of an embodiment of the umbrella assembly in an open position.

FIG. 1 illustrates an embodiment of an umbrella assembly 1. The umbrella assembly 1 comprises a canopy assembly 2 that can include a shade structure 4 and a frame 6. The frame 6 can have an upper portion 8 disposed below the shade structure and a lower portion 10 disposed below and supporting the upper portion 8.

The umbrella assembly 1 includes an upright pole (e.g., support pole 12) that has an upper portion 14 and a lower portion 16. The pole 12 is configured to be supported in an upright position by a base 18. The umbrella assembly 1 includes a collar 20 coupled with the upper portion 14 of the support pole 12. The umbrella assembly 1 includes a cantilevered beam 22 that has a first end 24 disposed below the shade structure 4. The first end 24 is coupled with the frame 6, as discussed further below. The cantilevered beam 22 has a second end 26 disposed adjacent to the support pole 12 when the umbrella assembly 1 is in an open position. The cantilevered beam 22 extends through the collar 20. As discussed more below, the cantilevered beam 22 preferably is extendable (e.g., slideable) through the collar 20 between extended and retracted configurations. The extended configuration generally corresponds to an open position of the canopy assembly 2. The retracted configuration generally corresponds to a closed position of the canopy assembly 2.

The umbrella assembly 1 can include a latch mechanism 28 coupled with the collar 20. The latch mechanism 28 preferably has a first configuration, e.g., un-latched (not shown) that permits the cantilevered beam 22 to be translated through the collar 20 between extended and retracted configurations. The latch mechanism 28 has a second configuration (e.g., latched), as shown in FIG. 1, in which the cantilevered beam 22 is prevented from being translated through the collar 20 between extended and retracted configurations. The latch mechanism 28 enables the canopy assembly 2 to remain open without being held open by a user.

Figure 9:
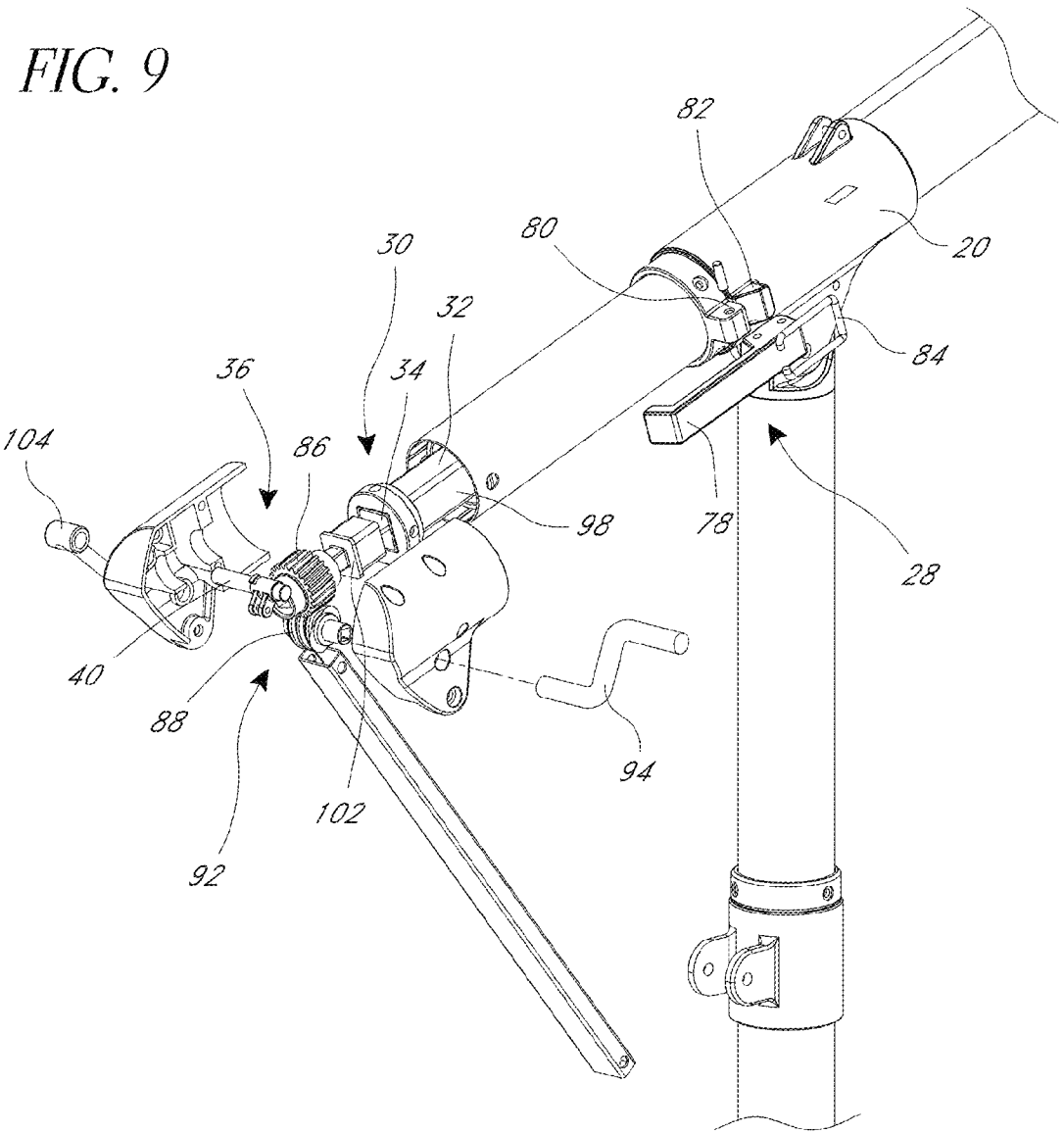
FIG. 9 is a detail exploded view of one end of the umbrella assembly as shown in FIG. 8.
Figure 10:
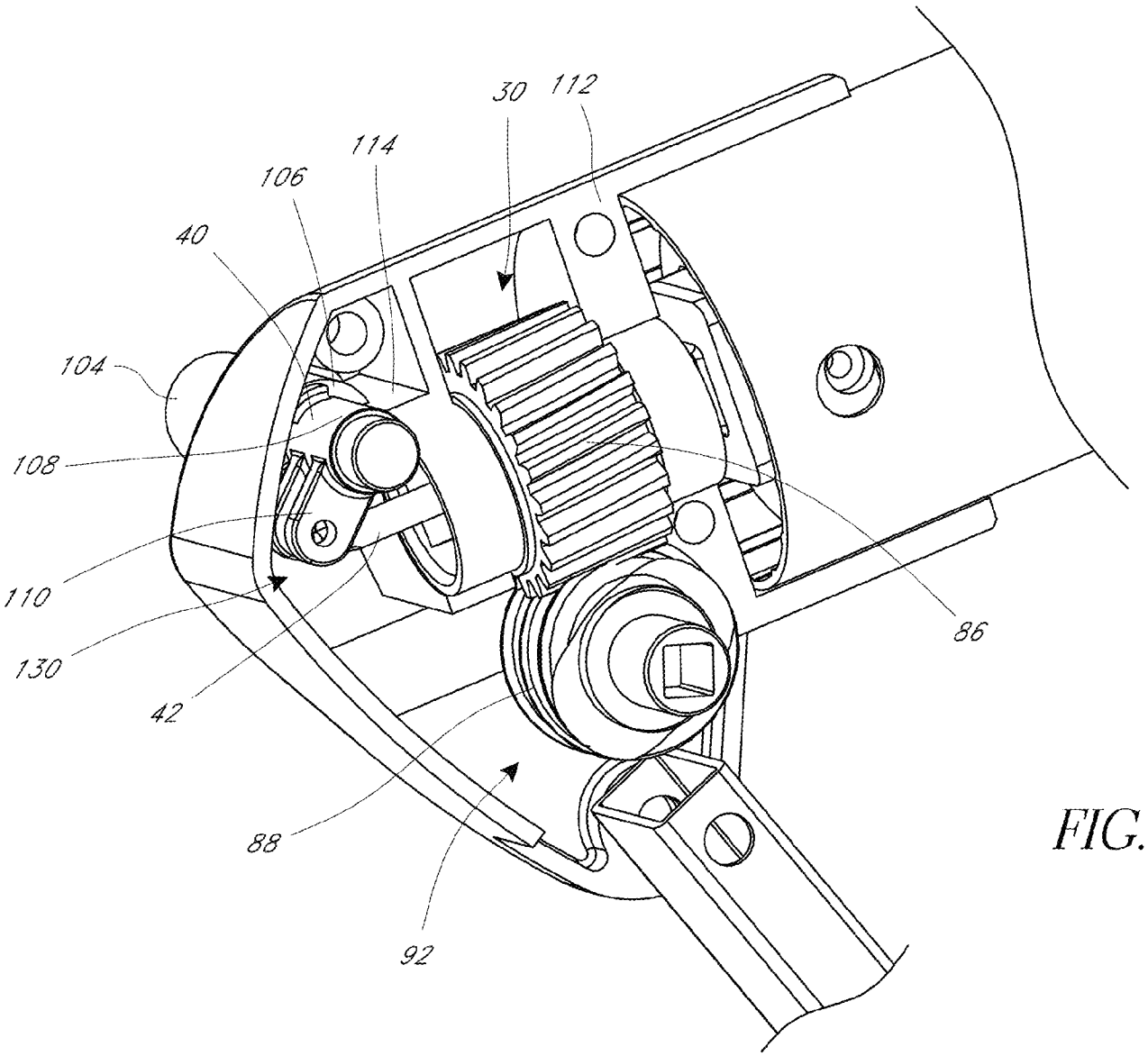
FIG. 10 is a detail view of one end of the umbrella assembly as shown in FIG. 8 with a portion of the housing removed for clarity.
Figure 11:
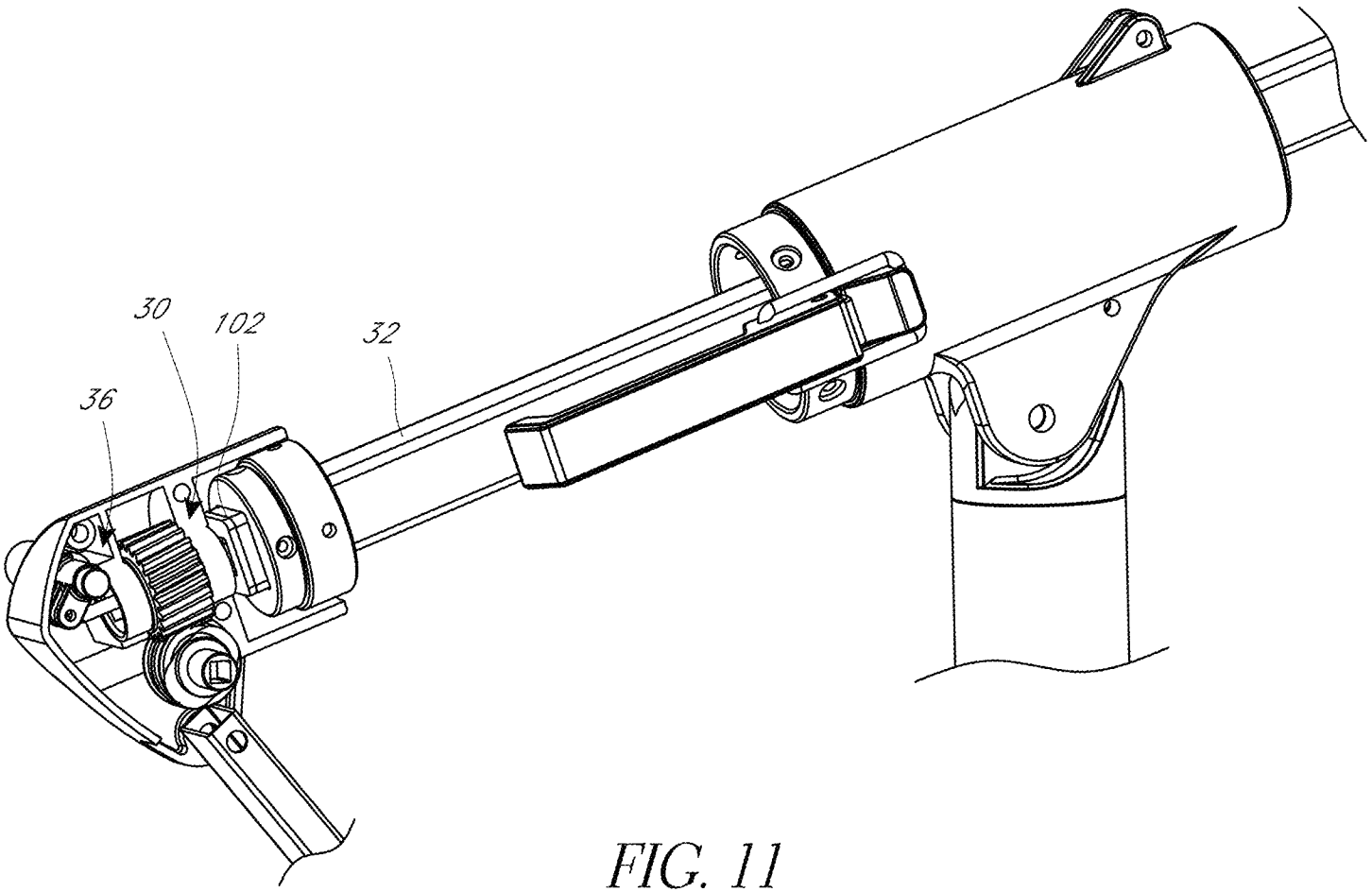
FIG. 11 is a detail view of one end of the umbrella assembly as shown in FIG. 8 with a canopy actuating cable and a portion of the housing and the cantilevered beam removed for clarity.
Figure 13:
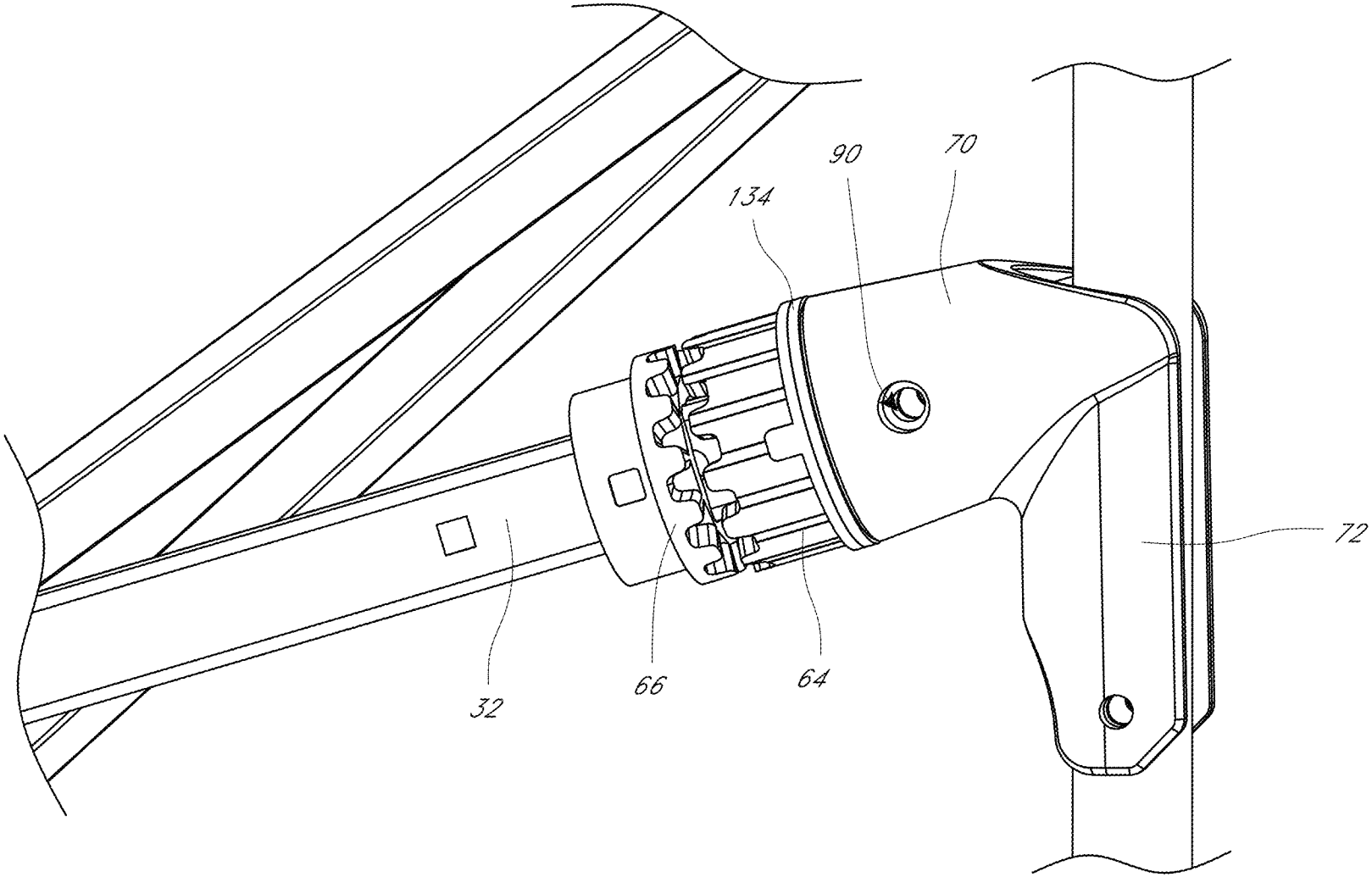
FIG. 13 is a detail view of another end of the umbrella assembly as shown in FIG. 8 with a portion of the cantilevered beam removed for clarity.

The umbrella assembly includes a tilt mechanism 30 disposed adjacent to or at the second end 26 of the cantilever beam 22. The tilt mechanism 30 is actuated adjacent to or at the second end 26 of the cantilever beam 22 to rotate the canopy assembly 2 at the first end 24 remotely. The tilt mechanism 30 includes an elongate member 32 (e.g., shaft), as illustrated in FIGS. 9 and 13, extending between the first and second ends 24 and 26 of the cantilever beam 22. The elongate member 32 has a channel 34 formed therein. Rotation of the elongate member 32 causes rotation of the canopy assembly 2.

In some embodiments, the umbrella assembly 1 includes a clutch mechanism 36 to actuate a device that maintains the canopy assembly 2 in any of a range of tilt positions. The clutch mechanism 36 includes or is coupled with a locking device 38 disposed within and adjacent to the first end 24 of the cantilevered beam 22. The clutch mechanism 36 also can include an actuator 40 disposed adjacent to the second end 26 of the cantilevered beam 22. The locking device 38 preferably includes first and second locking components 64 and 66 disposed adjacent to the first end 24. The clutch mechanism 36 also includes a tension member 42 (e.g., cable, rod, etc.) disposed within the channel 34 of the elongate member 32.

In some embodiments, the first locking component 64 is fixed to the cantilevered beam 22 adjacent to the first end 24. The second locking component 66 is slideable over the elongate member 32 (e.g., shaft) between a locked position and an unlocked position. When the second locking component 66 is in the unlocked position the second locking component 66 is rotatable with the elongate member 32 (e.g., shaft)

In some embodiments, the umbrella assembly 1 includes a device for actuating the canopy assembly 2 from a closed to an open position. One such device can be configured to automatically open the opening the canopy assembly 2 as the cantilevered beam 22 is extended, as discussed above. One such device includes a cable 44 having a first end 46 coupled with a fixed portion of the umbrella assembly 1 and a second end 48 coupled with the lower portion 10 of the frame 6 (e.g., coupled with a lower hub 52). In the variation illustrated in the figures, the first end 46 is coupled with the collar 20. In other variations, the first end 46 can be coupled with the upper portion 14 of the pole 12. The cable 44 includes a middle portion 50 disposed above the cantilevered beam 22. The cable 44 preferably has a fixed length such that as the cantilevered beam 22 is extended within the collar 20 to the extended configuration, the cable 44 applies an upward force to the lower portion 10 of the frame 6 to raise the lower portion 10 of the frame 6 (e.g., lower hub 52).

Figure 2:
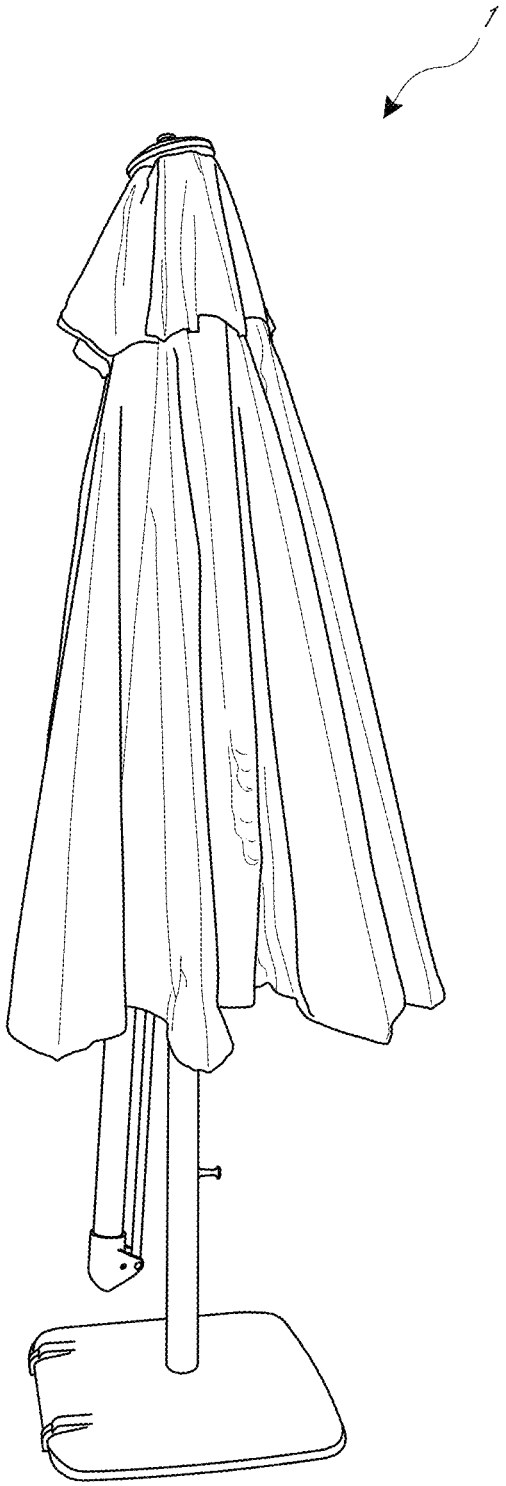
FIG. 2 is a side view of an embodiment of an umbrella assembly of FIG. 1 in a closed position.
Figure 3:
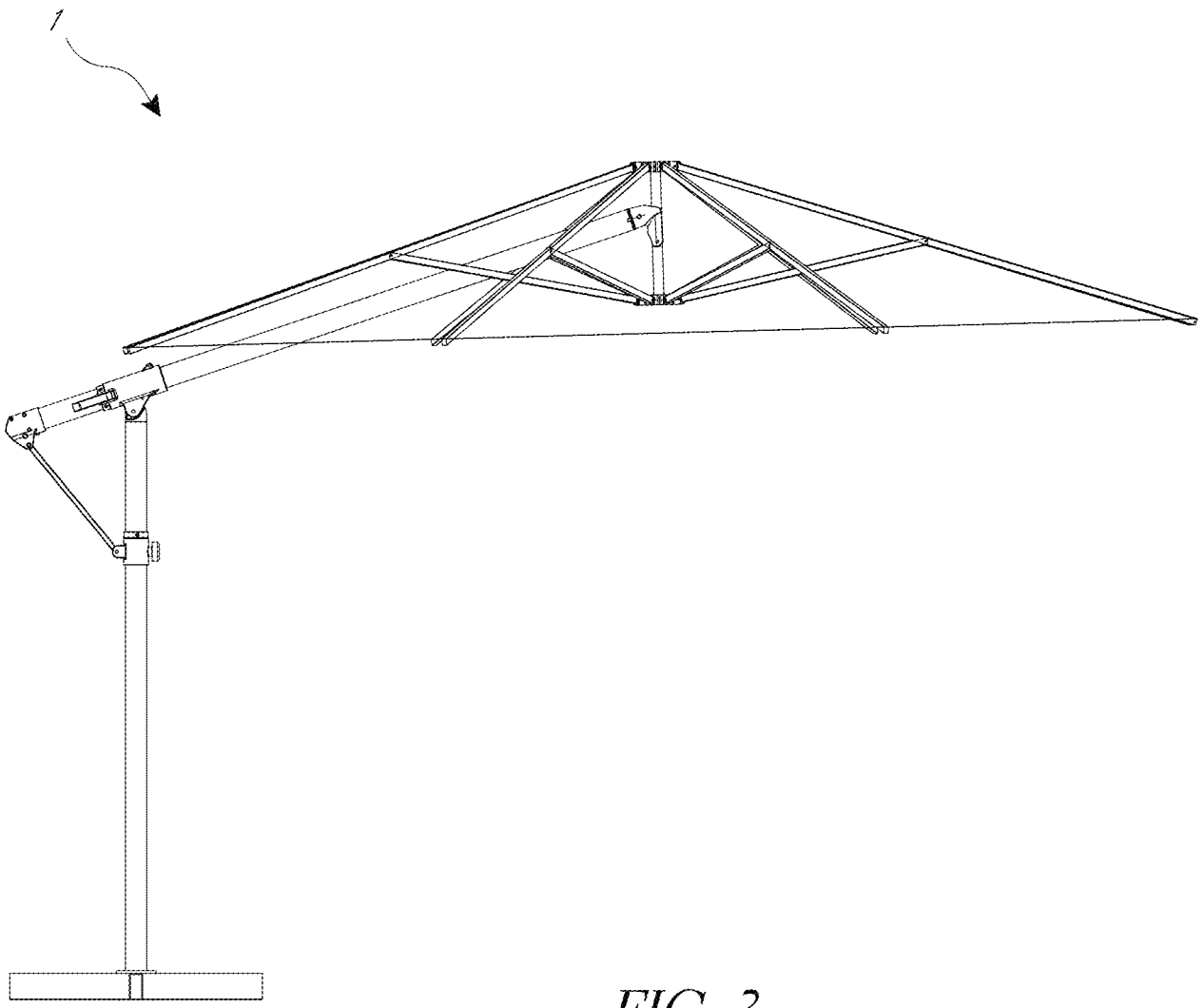
FIG. 3 is a side view of an embodiment of the umbrella assembly of FIG. 1 in an open position, with a canopy actuating cable removed for clarity.
Figure 4:
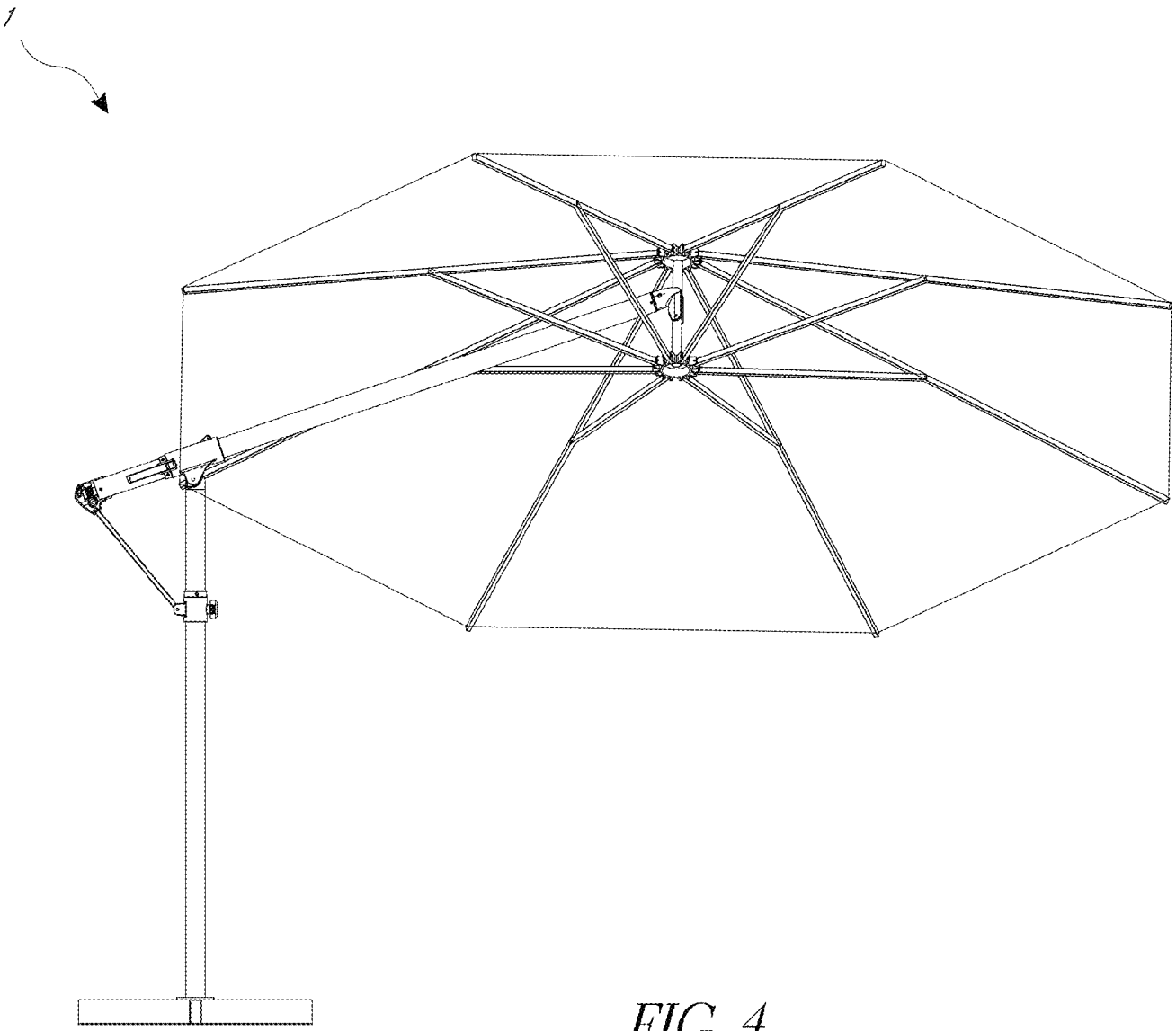
FIG. 4 is a side view of an embodiment of the umbrella assembly of FIG. 1 in an open position, tilted to one side by a tilt mechanism with a canopy actuating cable removed for clarity.

When the cantilevered beam 22 is fully extended and the latch mechanism 28 is in the second (e.g., latched) configuration, the cantilevered beam 22 is prevented from moving away from the fully extended position and the cable 44 is tensioned keeping the canopy assembly 4 fully open. In some embodiments, the fixed length cable 44 is tensioned as the cantilevered beam 22 is translated outward such that the tensioning causes the canopy frame 6 to open. In some embodiments, the canopy frame 6 is configured to move and be retained in an open position (as illustrated in FIG. 1) from a closed position (as illustrated in FIG. 2) and vice versa. For example, the canopy frame 6 can be moved to the closed position when the latch mechanism 28 is in the first configuration (or un-latched), by translating the cantilevered beam 22 inward toward the pole 12, releasing the tension in the cable 44.

In some embodiments, the first end 46 of the cable 44 is coupled to the collar 20. In some embodiments, the cable 44 is positioned above an exterior surface of the cantilevered beam 22 as illustrated in FIG. 1. In other embodiments, the cable 44 extends within a portion of the interior of the cantilevered beam 22. In some embodiments, the second end 48 of the cable 44 extends within first and second pole portions 56 and 58 of the canopy frame 6 and is coupled with the lower hub 52 of the canopy frame 6. In some embodiments, the second end 48 of the cable 44 extends within the first and second pole portions 56 and 58 from outside the pole portions 56 and 58 through an aperture 60 in the first pole portion 56.

Figure 6:
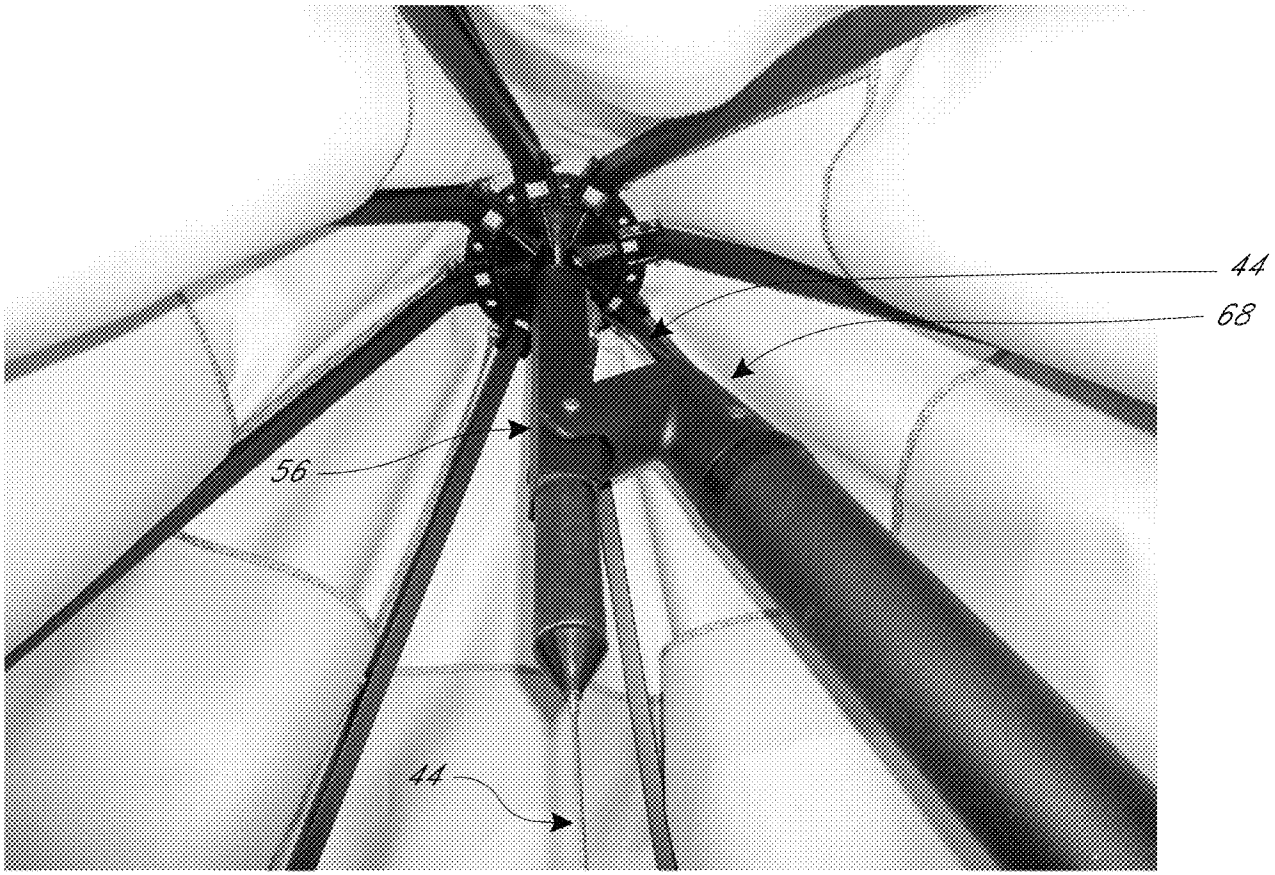
FIG. 6 is a partial bottom perspective view of the canopy of the umbrella of FIG. 1 in a partially open position.
Figure 7:
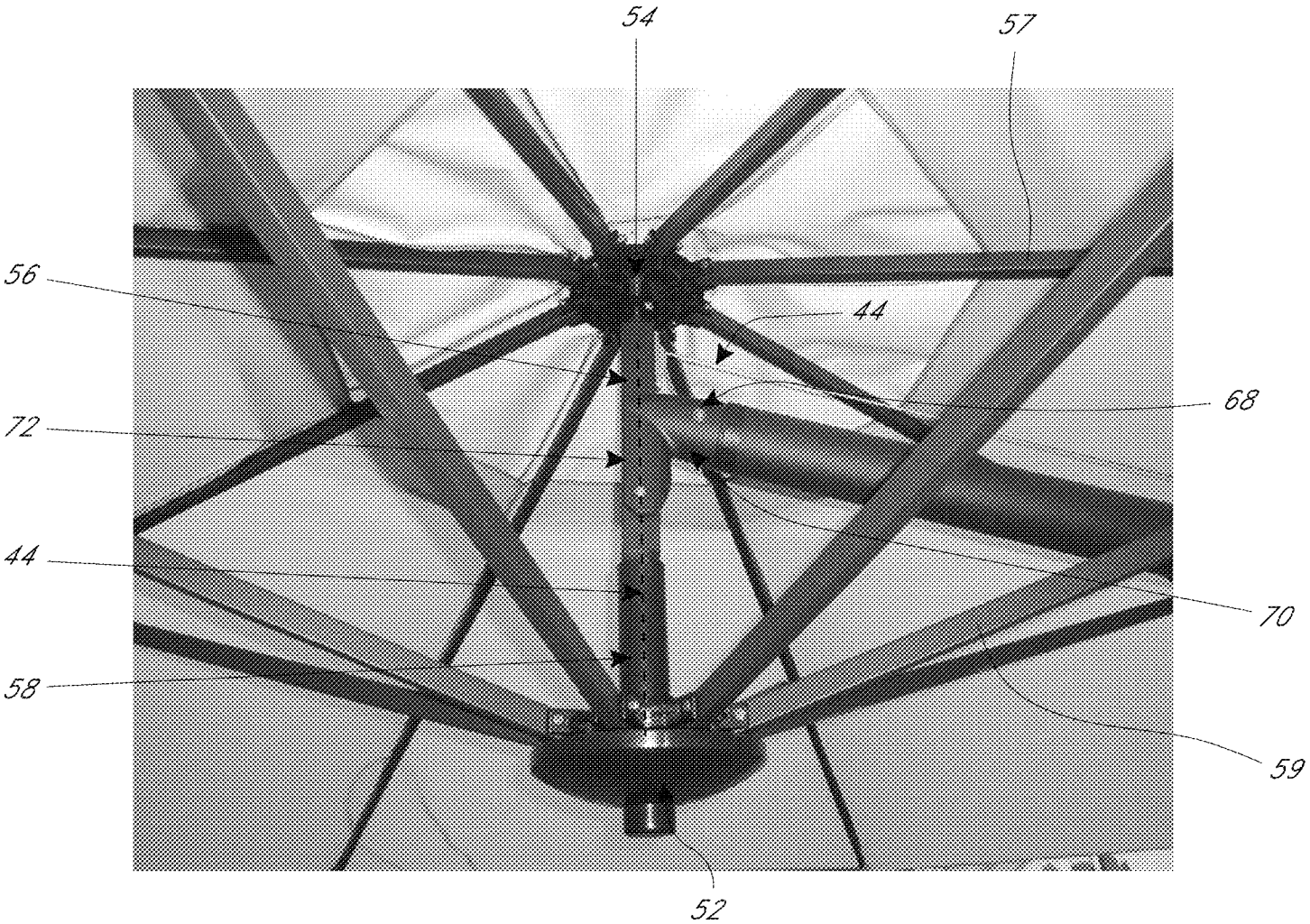
FIG. 7 is a partial bottom perspective view of the canopy of the umbrella of FIG. 1 in an open position.

In some embodiments, as illustrated in FIGS. 1 and 7, the umbrella assembly 1 comprises an upper portion 8 having an upper hub 54 with a plurality of ribs 57 extending outwardly thereof. The umbrella assembly 1 includes a lower portion 10 comprising a lower hub 52 having a plurality of struts 59 extending upwardly to the ribs 57. The umbrella assembly 1 includes a first pole portion 56 extending downwardly from the upper hub 54 and a second pole portion 58 extending upwardly from the lower hub 52. In some embodiments, the cable 44 is coupled with the lower hub 52 and extends within the first and second pole portions 56 and 58. In some embodiments, a bottom portion (as depicted in FIG. 6) of the first pole portion 56 is configured to be inserted into a channel disposed within second pole portion 58 when the canopy frame 6 is in the open position. In other embodiments, the second pole portion 58 is configured to be inserted into a channel disposed within the first portion 56.

Figure 5:
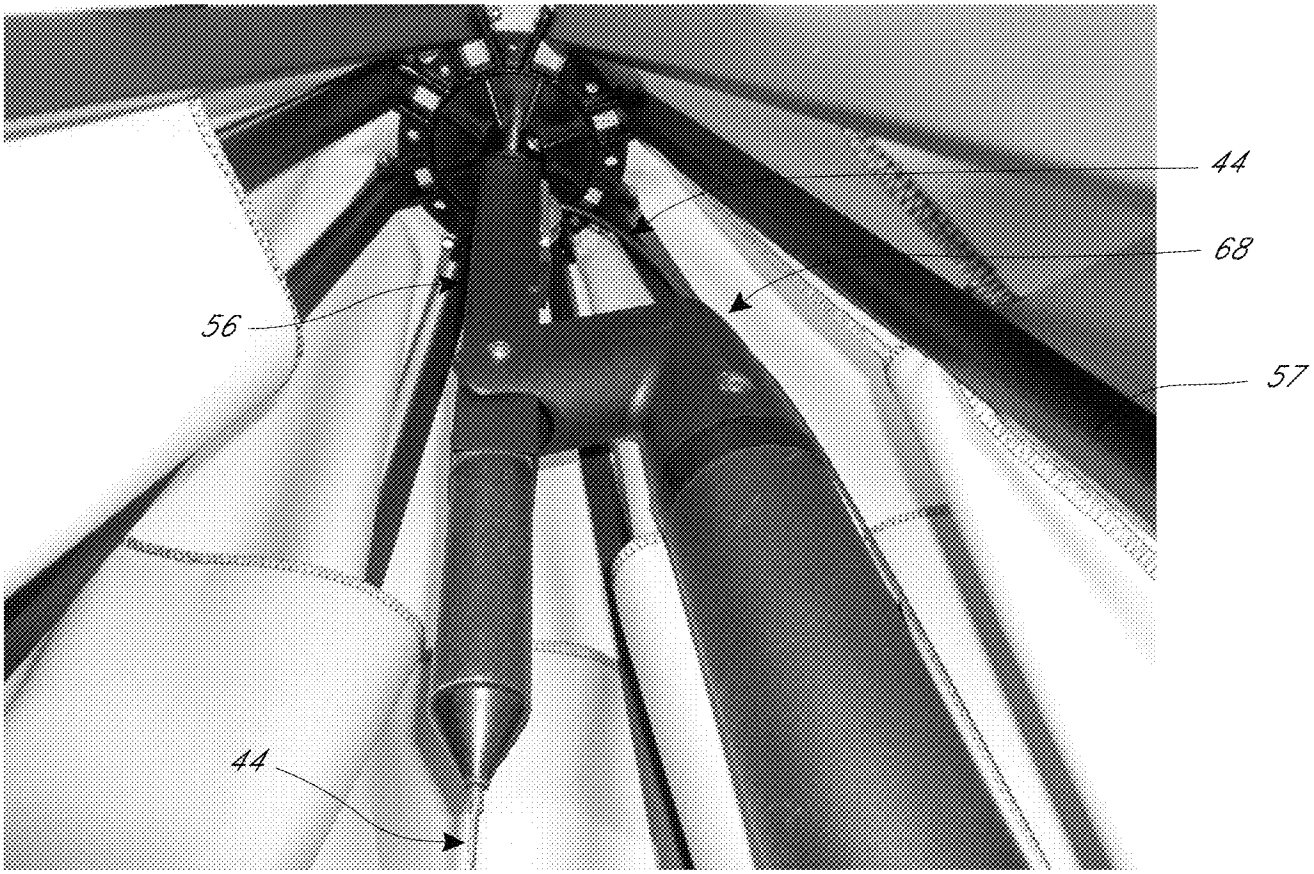
FIG. 5 is a partial bottom perspective view of the canopy of the umbrella of FIG. 1 in a closed position.

In some embodiments, the umbrella assembly 1 comprises an elbow member 68. The elbow member 68 includes a first portion 70 coupled with the first end 24 of the cantilevered beam 22 and a second portion 72 coupled with the first pole portion 56. The second portion 72 coupled to the first pole portion 56 permits the pole portion 56 to pivot relative to the second portion 72, as is clear from the orientations of these components in FIGS. 5-7. In some embodiments, the second portion 72 of the elbow member 68 comprises an arcuate, e.g., semicircular, sleeve 74 configured to receive and in some cases mate with the first pole portion 56 when the canopy frame 6 is open. In some embodiments, the second portion 72 of the elbow member 68 comprises an arcuate, e.g., semicircular, recess 76 configured to receive and in some cases mate with the first pole portion 56 when the canopy frame 6 is closed. In some embodiments, the elbow member 68 is configured to be arcuate in shape or L-shaped such that the first portion 70 extends in a direction generally transverse to the second portion 72.

Figure 8:
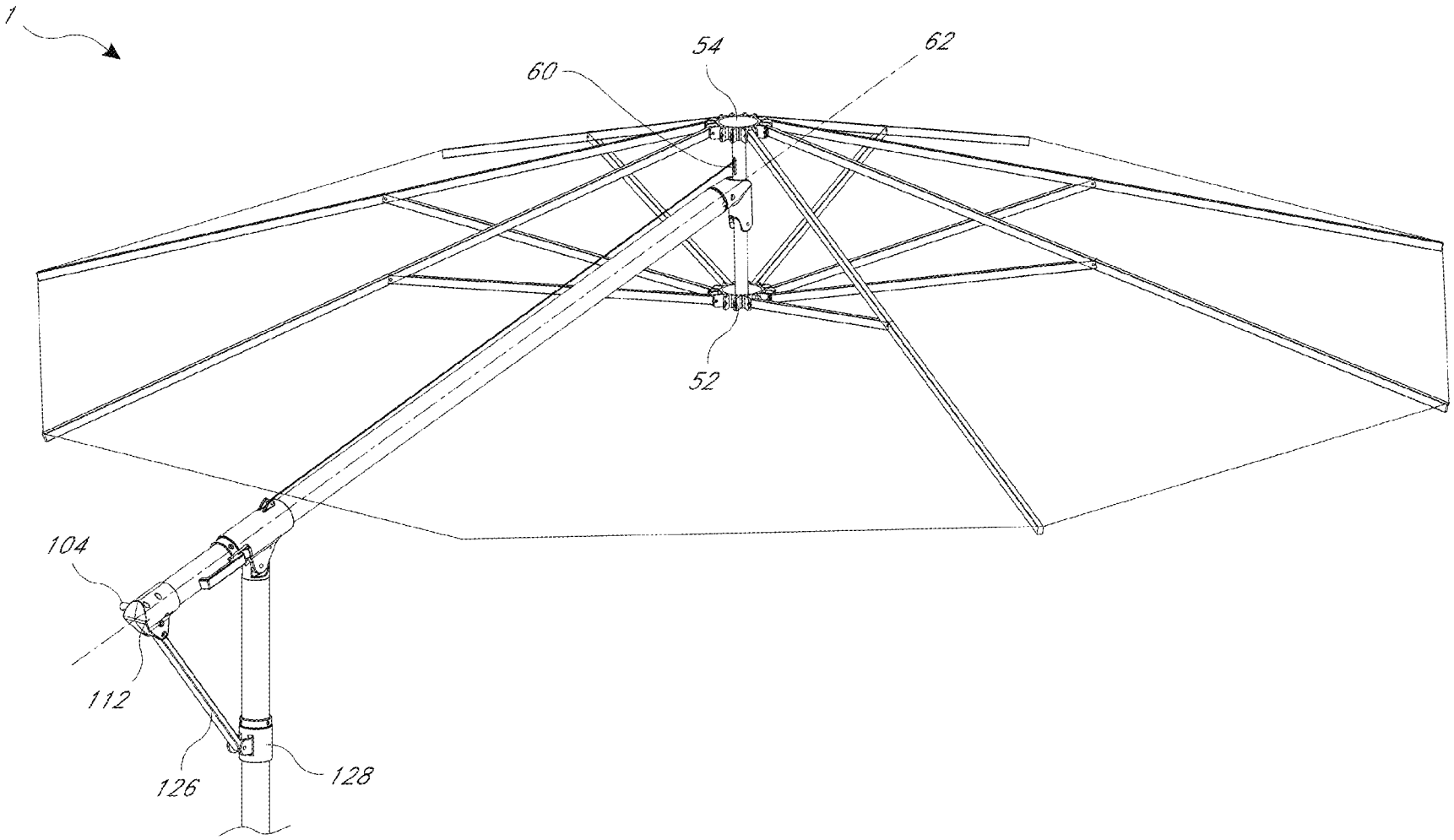
FIG. 8 shows a partial section of the umbrella assembly of FIG. 1.

As discussed above, in some embodiments, the umbrella assembly 1 includes a collar 20 coupled with the upper portion 14 of the upright pole 12. The collar 20 has a channel through which the cantilevered beam 22 can slide inward toward the pole 12 to close the canopy frame 6 and outward to open the canopy frame 6. In some embodiments, the latch mechanism 28 includes a handle 78 hingedly coupled to a first engagement member 80 (e.g., protrusion) disposed on the collar 20. In some embodiments, the first engagement member 80 is disposed on a sleeve coupled to the cantilevered beam 22. As illustrated in FIG. 8, the latch mechanism 28 includes a loop or hook member 84 configured to be secured with a second engagement member 82 (e.g., protrusion) when the latch mechanism 28 is in the second configuration. The second engagement member 82 is disposed adjacent to the first engagement member 80. When the latch mechanism 28 is in the first configuration, the loop or hook member 84 can be unsecured from the second engagement member 82. In some embodiments, the latch mechanism 28 is configured to move to the first configuration as the handle 78 is rotated away from the cantilevered beam. The latch mechanism 28 is configured to move to the second configuration as the handle 78 is rotated away from the canopy assembly 4 or towards the second end 26 of the cantilevered beam 22.

As discussed above, in some embodiments, the umbrella assembly 1 includes a tilt mechanism 30. In some embodiments, the tilt mechanism 30 comprises a worm gear 86 engaged with the elongate member 32 disposed in the cantilever beam 22. The elongate member 32 is coupled with the canopy frame 6 by the clutch mechanism 36. In some embodiments, the tilt mechanism 30 includes a first portion (e.g., including the elongate member 32) and a second portion (e.g., including the shaft 92). The first portion extends through the cantilevered beam 22 to a first end 90. The first end 90 is rotatably coupled with the first portion 70 of the elbow member 68. The second portion is configured to receive the crank handle 94. Rotation of the crank handle 94 actuates the second portion to rotate the first portion (e.g., including elongate member 32) of the tilt mechanism 30 and the first portion 70 of the elbow member 68 about an axis 62 extending through the cantilevered beam 22. In some embodiments, the first portion of the tilt mechanism 30 is rotated about an axis transverse to a longitudinal axis of the upright pole. In some embodiments, the worm gear 86 engages with the elongate member 32 via a shaft 102 coupled to the worm gear 86. The shaft 102 can extend into engagement with the channel 34 formed within the elongate member 32.

In one configuration, torque is transferred between the shaft 102 and the elongate member by a direct drive construction. For example, the elongate member 32 and shaft 102 can each comprise one or more flat or planar sides or surfaces. The flat or planar side or surface of the shaft 102 can directly engage the flat or planar side or surface of the elongate member 32 to assure that torque is directly applied to the elongate member 32 by the shaft 102 when the worm gear 86 is rotated. Advantages of such surfaces are discussed further below. In other embodiments, non-flat surfaces can be used such as arched, circular or round. For example, an outer surface can be provided for the shaft 102 and the elongate member 32 that has a plurality of arcuate surfaces separated by substantially linear segments. This construction permits the shaft 102 to be received in the elongate member 32 but prevents the shaft from rotating in the elongate member. Rotation of the shaft 102 directly rotates the elongate member 32.

In some embodiments, the tilt mechanism 30 includes a worm gear arrangement such that a worm 88 is configured to drive or rotate the worm gear 86. The worm 88 includes a second portion or shaft 92 engageable by the crank handle 94 for turning the worm 88 clockwise and counter-clockwise to drive or rotate the worm gear 86. Rotation of the worm gear 86 rotates the elongate member 32 and the elbow member 68, and as a result, tilts the canopy frame 6. The worm gear 86, elongate member 32 and elbow member 68 each rotate about the axis 62. This rotation enables the canopy assembly 2 and shade structure 4 to be positioned at a range of tilt angles relative to the axis 62, which allows the user to move the shade cast by the umbrella assembly 1 to a desired position. In some embodiments, the canopy assembly 2 is rotated about an axis extending transversely to a longitudinal axis of the upright pole. In some embodiments, the worm 88 and worm gear 86 arrangement includes a self-locking feature of worm devices as is known by those with skill in the art. For example, internal resistance can be sufficient to allow the worm gear 86, elongate member 32, elbow member 68, and canopy assembly 2 to hold a desired position without a separate locking device. In other embodiments as discussed elsewhere herein a separate locking device is provided.

In some embodiments, the clutch mechanism 36 comprises an actuator 40 disposed at the second end 26 of the cantilevered beam 22 and a tension member 42 (e.g., cable, rod, etc.) disposed within the elongate member 32 within the cantilevered beam 22. The actuator 40 can comprise a handle, lever, or other rotatable mechanism 104, a shaft 108, an engagement portion 110 and a stop mechanism 106. In some embodiments, the engagement portion 110 extends radially outward from an outer surface of the shaft 108 and is engaged with the tension member 42. The handle 104 is configured to be coupled with the shaft 108 such that pulling or pushing the handle 104 produces tension in the tension member 42 (e.g., cable, rod, etc.). Releasing the handle 104, releases the tension in the tension member 42. Stop member 106 extends radially out from an outer surface of the shaft 108 and is configured to abut with an inner surface 114 of a housing 112 that a portion of the actuator 40 and worm gear 86 of the tilt mechanism 30 are positioned within. The stop member 106 is configured to abut the inner surface 114 to provide a limit to tensioning the tension member 42 by actuating the handle 104. The stop member 106 also defines the range of motion of the actuator 40 by preventing its rotation beyond the point of contact of the stop member with the inner surface 114. The contact position can correspond to the fully actuated state. In some embodiments, the actuator 40 moves from the fully actuated state to the unactuated state by releasing a torsional spring that is coupled with the actuator 40. The spring is deformed to store spring energy as the actuator moves toward the fully actuated state. The spring releases the store spring energy as the actuator moves away from the fully actuated state.

Figure 14:
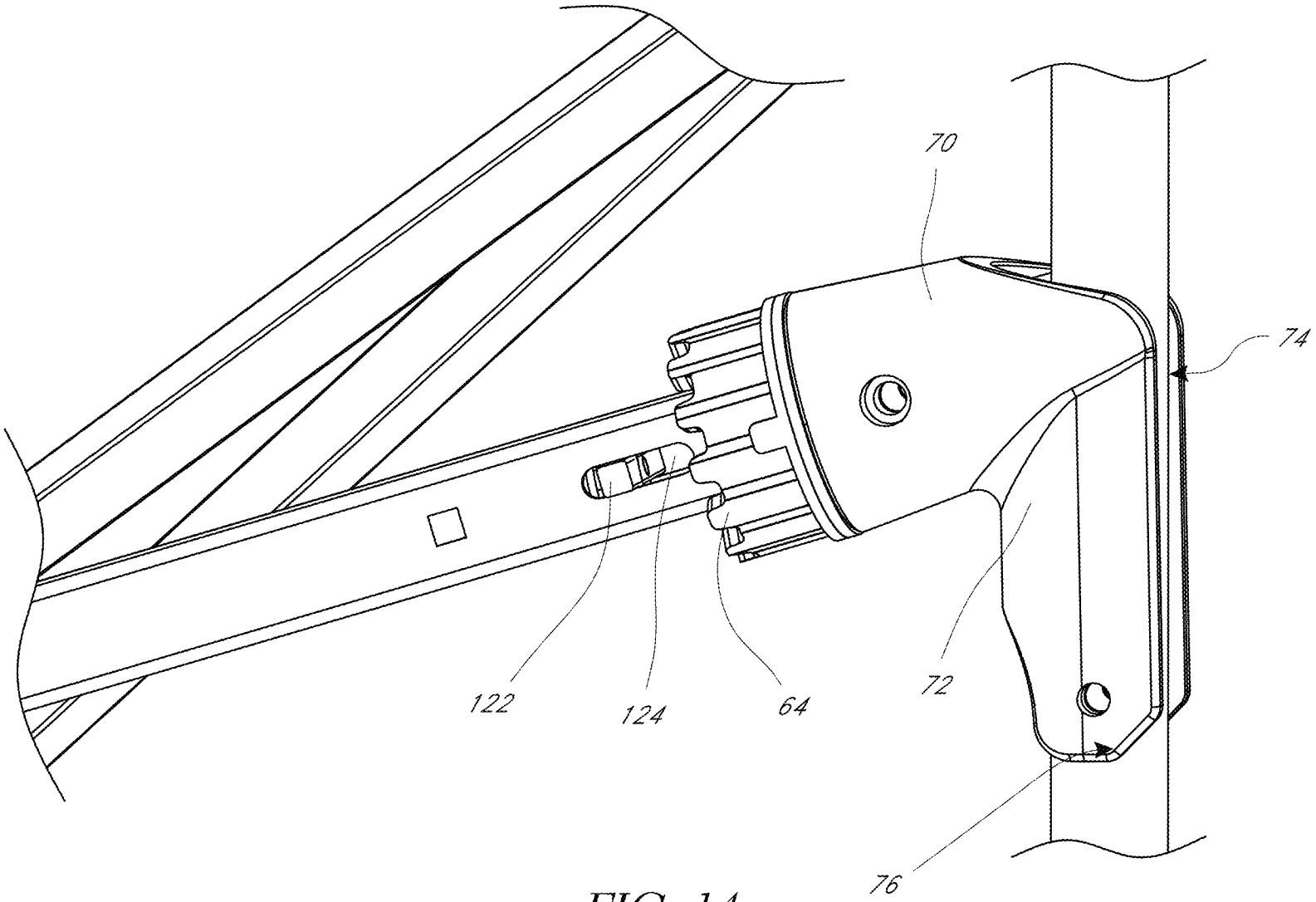
FIG. 14 is a detail view of another end of the umbrella assembly as shown in FIG. 8 with a portion of the cantilevered beam and the clutch mechanism removed for clarity.
Figure 15:
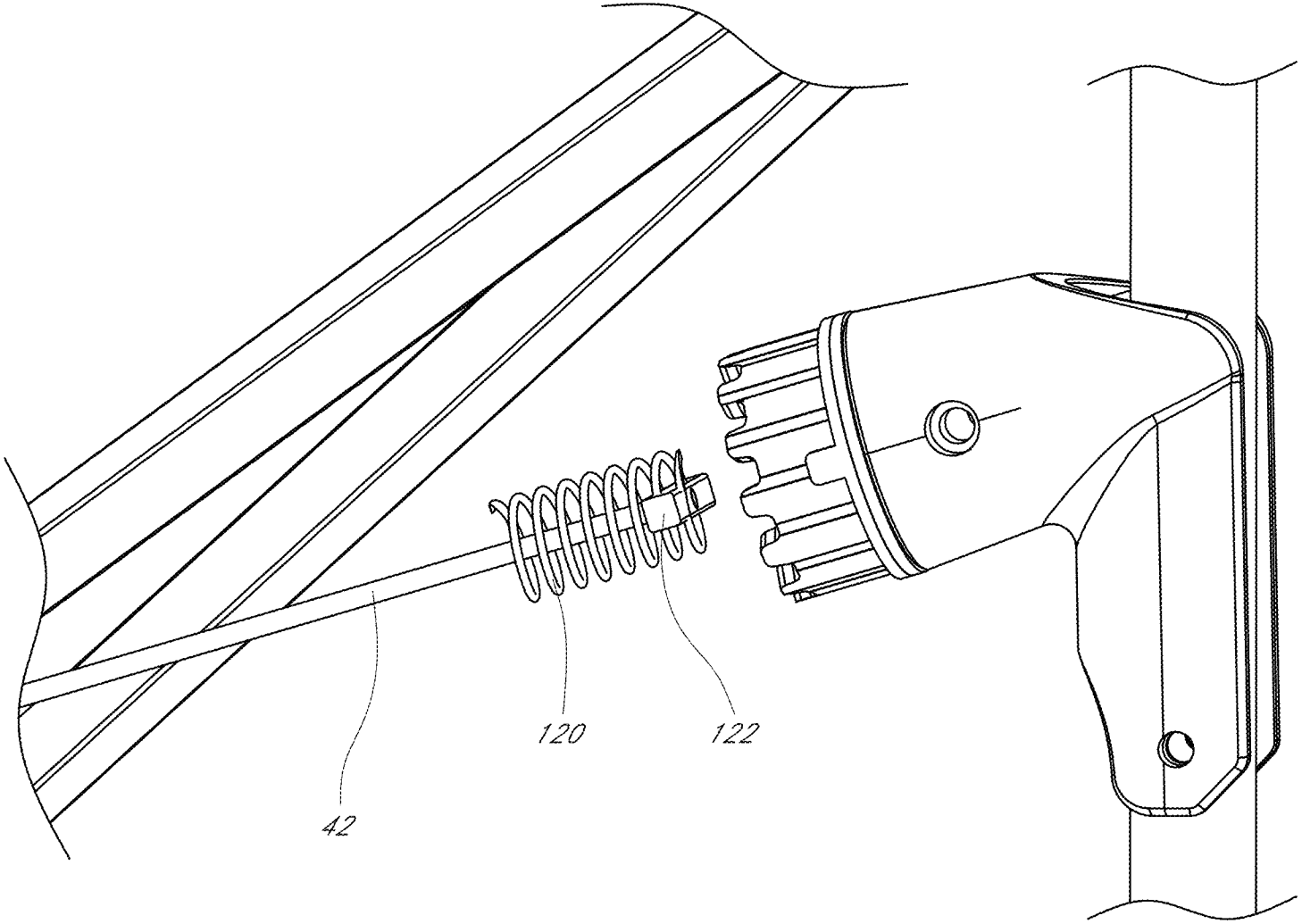
FIG. 15 is a detail view of another end of the umbrella assembly as shown in FIG. 8 with a portion of the cantilevered beam, the clutch mechanism, and the tilt mechanism removed for clarity.
Figure 16:
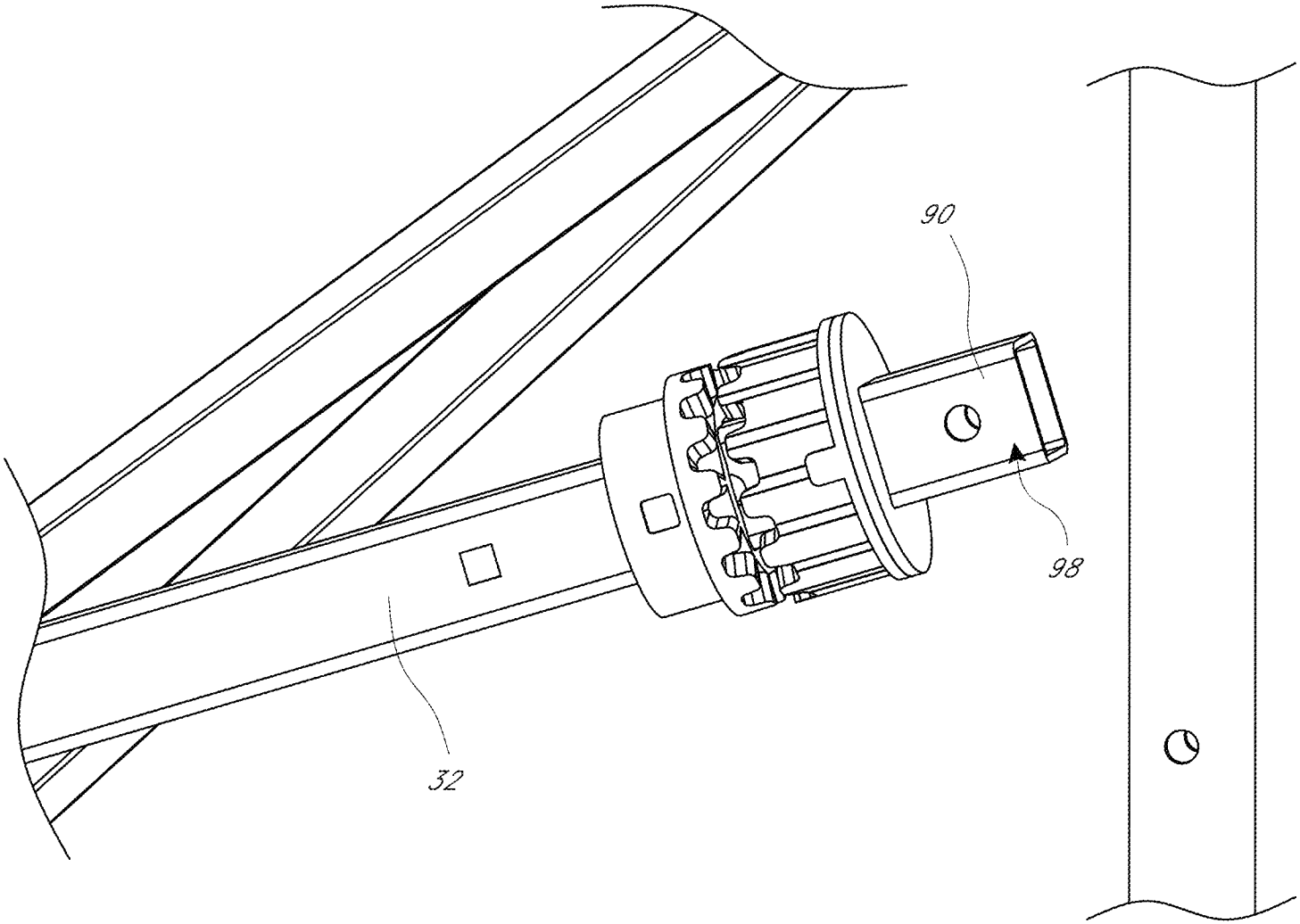
FIG. 16 is a detail view of another end of the umbrella assembly as shown in FIG. 8 with a portion of the cantilevered beam and elbow removed for clarity.

In some embodiments, the first end 130 of the tension member 42 is coupled to the actuator 40. The second end 132 is coupled to an engagement member 122 (e.g., block, shaft, etc.). The engagement member 122 is secured to the second locking component 66 of the clutch mechanism 36. In some embodiments, the engagement member 122 extends in a generally transverse direction through the second locking component 66. In some embodiments, one or more elastic members 120 (e.g., springs) are coupled to a side of the engagement member 122 facing away from the elbow member 68. As discussed herein, the elongate member 32 extends within the cantilevered beam 22. The tension member 42 extends within the channel 34 of the elongate member 32. Applying a force to the handle 104 of the actuator 40 creates tension in the tension member 42. Such tension, moves engagement member 122 rearwards and the second locking component 66 into the unlocked position and out of engagement with the first locking component 64. In some embodiments, the engagement member 122 slides in a rearward direction, compressing the one or more elastic members 120, and moving the second locking component 66 along the elongate member 32 towards the second end 26. As shown in FIG. 14, the elongate member 32 includes a recess 124 configured for the engagement member 122 to slide rearward towards the second end 26 and forwards toward the first end 24 such that the second locking component 66 can be moved into the locked and unlocked positions (e.g., into and out of engagement with first locking component 64).

In some embodiments, maintaining tension in the tension member 42 allows the second locking mechanism 66 to remain in the unlocked position. As such, the umbrella canopy 6 can then be rotated or tilted. By turning the handle 94, the worm 88 can drive the worm gear 86 and rotate the elongate member 32 to tilt the elbow member 68 and thus the umbrella canopy 6. Releasing the handle 104 releases the tension in the tension member 42 and the one or more elastic members 120 bias the second locking component 66 to the locked position and into engagement with the first locking component 64. In some embodiments, corresponding geared or toothed members of the first and second locking components 64 engage with one another to secure the second locking component 66 into the locked position wherein rotation or tilting of the canopy frame 6 is prevented. In some embodiments, the first locking component 64 includes a protrusion 118 positioned on an exterior surface of the first locking component 64. The protrusion 118 is permanently received in a slot, notch or recess 116 formed in the first end 24 of the beam 22. Thus the first locking component 64 is prevented from rotating relative to the beam 22 in all states of the clutch mechanism 36. Other ways can be provided for non-rotatably connecting the first locking component 64 to the beam 22 can include screws and other fasteners, cap structures enclosing at least a portion of both the component 64 and the beam 22, an interference fit, and combinations of these approaches. When the second locking component 66 is in the locked position, engaged with the first locking component 64, the second locking component 66 is prevented from rotating relative to the beam 22. This locked state prevents rotation or tilting of the elbow member 68 and the frame 6.

Rotation and tilting of the elbow member 68 and the frame 6 is enabled by actuating the clutch mechanism 36 such that the second locking component 66 is moved away from the first locking component 64 such that these components do not engage. In this position, the elongate member 32 which extends through but does not engage the first locking component 64 can rotate. As discussed further below, the first end 90 of the elongate member 32 is received in the elbow member 68 to directly rotate the elbow member.

Figure 17:
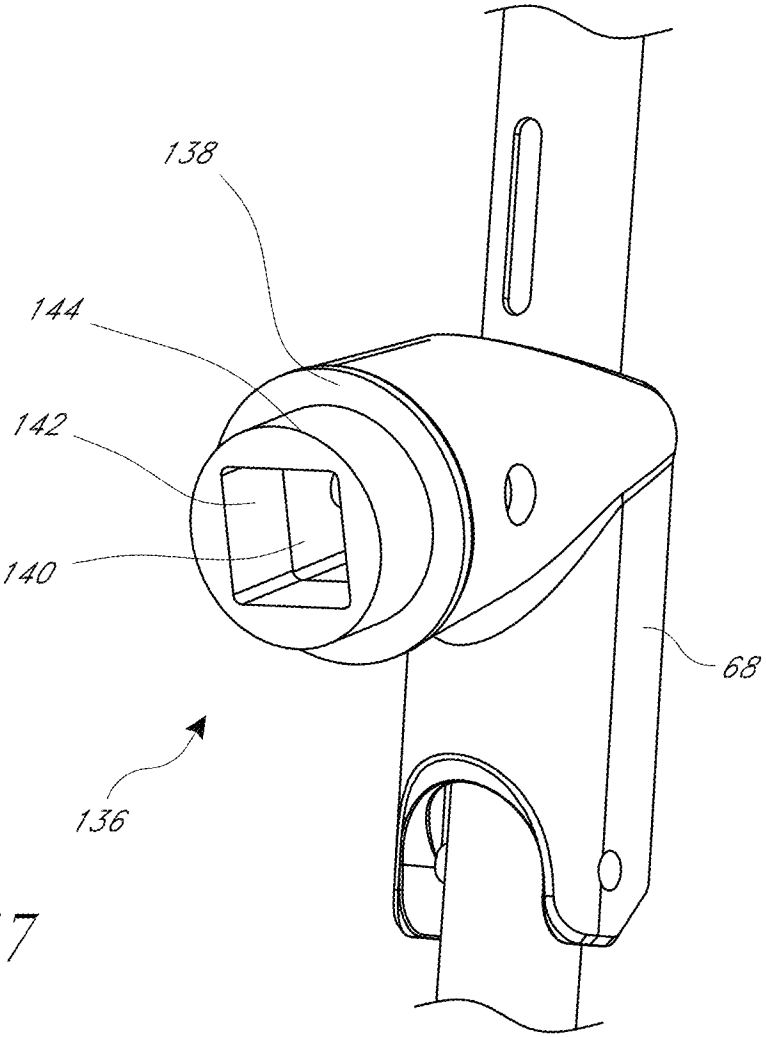
FIG. 17 is a detail view of another end of the umbrella assembly as shown in FIG. 8 with a canopy actuating cable and a portion of the cantilevered beam, tilt mechanism and the clutch mechanism removed for clarity.

In some embodiments, a rotation interface 134 is provided between the first locking component 64 and the elbow member 68. In one embodiment, as illustrated in FIG. 17, a low friction sleeve 136 is provided that includes an outwardly projection flange 138 that contacts the outer face of the first locking component 64 on one side and that contacts the inner face of the first portion 70 of the elbow member 68 on the other side. The sleeve 136 includes an inner portion 142 that is disposed on the elongate member 32. The sleeve 136 includes an aperture 140 through which the elongate member 32 is disposed. The aperture 140 preferably includes a perimeter that matches the outer perimeter of the elongate member 32. If the elongate member 32 is square the inner perimeter of the aperture 140 can also be square. In one embodiment, the inner portion 142 of the sleeve 136 projects away from the elbow member 68 into a space surrounded by the inner surface of the first locking component 64. The outer face 144 of the projection of the inner portion 142 of the sleeve 136 faces the inner surface 146 of the first locking component 64. The sleeve 136 is preferably a low friction material such that the force required to rotate the elongate member 32, the elbow 68 and the canopy assembly 2 is minimized.

Figure 12:
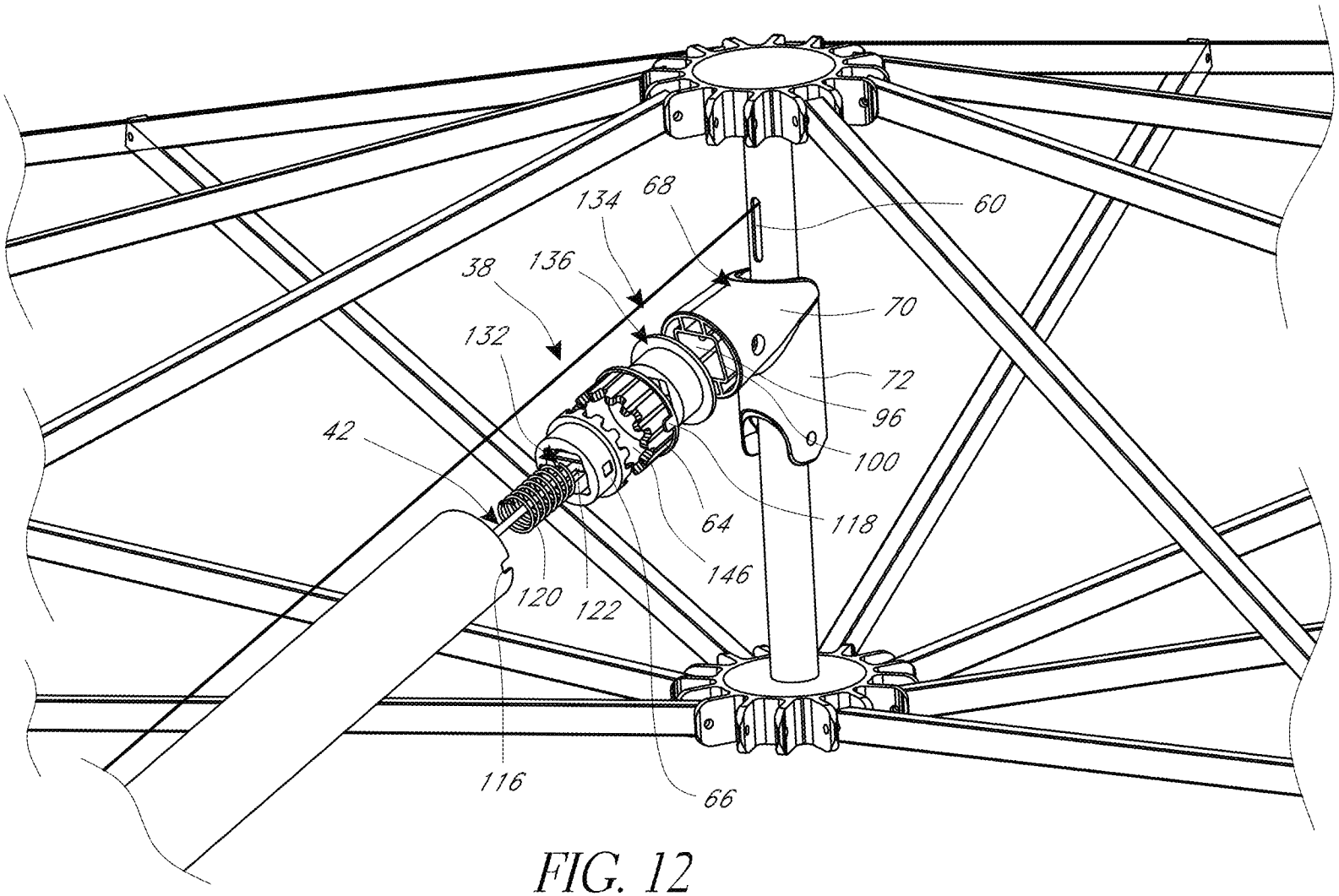
FIG. 12 is a detail exploded view of another end of the umbrella assembly as shown in FIG. 8 with a portion of the tilt mechanism removed for clarity.

As illustrated in FIG. 12, in some embodiments, the second locking component 66 that is slidable and rotatable is positioned between the second end 24 of the cantilevered beam 22 and the first locking component 64. In some embodiments, the first and second locking components 64, 66, elongate member 32, tension member 42 are positioned within the cantilevered beam 22.

In some embodiments, the housing 112 can comprise two or more pieces configured to couple together and contain a space therein for the components of the tilt mechanism 30 and the clutch mechanism 36. In some embodiments, the housing 112 is coupled to the second end 26 of the cantilevered beam 22. Both the handle 104 and the crank handle 94 can be integrated with the respective shafts 108, 92 they are configured to rotate separately or to be formed as separate pieces. In some embodiments, the handle 104 and crank handle 94 can be inserted into openings that extend from an exterior surface of the housing 112 into the interior of the housing 112 to engage the respective shafts 108, 92.

In some embodiments, the housing 112 is rotatably coupled to a second pole 126 as illustrated in FIG. 8. The second pole 126 is coupled to the upright pole 12 below the collar 20. One end of the second pole 126 is coupled to the housing 112 and a second end of the second pole 126 is coupled to the upright pole 12. The second end of the second pole 126 can be coupled directly to the pole 12 or to a second collar 128 secured to the upright pole 12.

In some embodiments, the first portion of the elbow member 68 comprises a recess 96 formed therein and the first end 90 of the first portion (e.g., elongate member 32) of the tilt mechanism 30 is disposed in the recess 96. In some embodiments, the first end 90 of the first portion (e.g., elongate member 32) of the tilt mechanism 30 is configured to mate with the recess 96 of the elbow member 68 to directly apply a torque to the elbow member 68. In some embodiments, the first portion of the tilt mechanism 30 comprises an elongate member 32 (e.g., shaft) with at least a flat (e.g., planar) side 98 and the recess 96 of the elbow member 68 comprises a corresponding flat (e.g., planar) surface 100. In some embodiments, the corresponding flat side 98 and flat surface 100 are configured to mate or engage such that torque can be applied directly to the elbow member 68 from the elongate member 32 (e.g., shaft). In some embodiments, such an arrangement with corresponding flat sides and/or surfaces allows the transmission of torque between the elongate member 32 (e.g., shaft) and elbow member 68 without the need for additional transmission components such as gears or toothed members. For example, the recess 96 and the elongate member 32 (e.g., shaft) can comprise cross sectional shapes such as a square, rectangle, hexagon, pentagon, trexagon, triangle, or any other shape with at least one flat or planar side. For these structures and the direct drive surface discussed above for the end of the elongate member 32 disposed in the housing 112, the flat sides can be any non-round cross-sectional profile such that pins or other connectors are not required to transfer torque between the mating structures. In other embodiments, the recess 96 or elongate member 32 (e.g., shaft) can comprise a round, cylindrical, or arcuate cross section.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella assembly comprising:

an upright pole;

a cantilevered beam having a first end disposed away from the upright pole and a second end disposed adjacent to the upright pole;

a canopy frame coupled with the first end of the cantilevered beam;

a tilt mechanism operable to rotate the canopy frame about an axis extending through the cantilevered beam, the tilt mechanism including a rotatable shaft disposed in the cantilevered beam; and a clutch mechanism including a first component fixed to the cantilevered beam adjacent to the first end and a second component, the clutch mechanism having an engaged configuration and a disengaged configuration such that when the clutch mechanism is in the disengaged configuration the second component is disposed closer to the upright pole than when the clutch mechanism is in the engaged configuration;

wherein when the clutch mechanism is in the disengaged configuration the second component is rotatable with the shaft; and wherein when the clutch mechanism is in the engaged configuration the second component is prevented from rotating in a clockwise direction and in a counter-clockwise direction about the axis.

2. The umbrella assembly of claim 1, further comprising a fixed length cable that is tensioned as the cantilevered beam is translated outward, the tensioning causing the canopy frame to open.

3. The umbrella assembly of claim 2, wherein the canopy frame comprises:

an upper portion having an upper hub with a plurality of ribs extending outwardly thereof;

a lower portion comprising a lower hub having a plurality of struts extending upwardly to the ribs;

a first pole portion extending downwardly from the upper hub; and a second pole portion extending upwardly from the lower hub.

4. The umbrella assembly of claim 3, wherein the fixed length cable is coupled with the lower hub and extends within the first and second pole portions.

5. The umbrella assembly of claim 4, further comprising an elbow member having a first portion coupled with the first end of the cantilevered beam and a second portion pivotally coupled with the first pole portion.

6. The umbrella assembly of claim 5, wherein the second portion of the elbow comprises a semicircular sleeve configured to mate with the first pole portion when the canopy frame is open.

7. The umbrella assembly of claim 5, wherein the second portion of the elbow comprises a semicircular recess configured to mate with the first pole portion when the canopy frame is closed.

8. The umbrella assembly of claim 2, further comprising a collar coupled with the upper portion of the upright pole, the collar permitting the cantilevered beam to slide therein inward and outward.

9. The umbrella assembly of claim 8, further comprising a latch mechanism coupled with the collar having a first configuration that permits the cantilevered beam to be translated through the collar to open and close the canopy frame.

10. The umbrella assembly of claim 2, wherein the tilt mechanism comprises a worm gear engaged with the shaft disposed in the cantilever beam, the shaft being coupled with the canopy frame by the clutch mechanism.

11. The umbrella assembly of claim 10, wherein the clutch mechanism comprises a lever disposed at the second end of the cantilevered beam and a tension member disposed within the shaft within the cantilevered beam.

12. An umbrella assembly comprising:

an upright pole having a longitudinal axis;

a cantilevered beam having a first end disposed away from the upright pole and a second end disposed adjacent to the upright pole;

a canopy frame coupled with the first end of the cantilevered beam;

a clutch mechanism including an actuator disposed away from the canopy frame, the actuator adapted to disengage a locking device disposed adjacent to the canopy frame; and a tilt mechanism positioned between the actuator and the canopy frame, the tilt mechanism having a rotatable portion that is adapted to rotate the canopy frame about an-axis extending transverse to the longitudinal axis of the upright pole;

wherein a portion of the clutch mechanism extends from the actuator to the locking device adjacent to the first end of the cantilevered beam through the rotatable portion of the tilt mechanism.

13. An umbrella assembly of claim 12, the actuator is disposed adjacent to the second end of the cantilevered beam, the locking device is disposed adjacent to the first end of the cantilevered beam, and the tilt mechanism is positioned between the actuator and the first end of the cantilevered beam.

14. An umbrella assembly comprising:

an upright pole;

a canopy frame coupled with and disposed laterally of the upright pole at least when the umbrella assembly is open;

a tilt mechanism having a first portion extending between the upright pole and the canopy frame and a second portion configured to be actuated to cause the first portion to rotate about an axis extending transverse to the upright pole; and an elbow member having a first portion coupled to an end of the first portion of the tilt mechanism disposed away from the upright pole and a second portion rotatably coupled to the canopy frame;

wherein the first portion and the second portion of the elbow member are disposed within the canopy frame between an upper hub having a plurality of ribs extending outwardly thereof and a lower hub having a plurality of struts extending upwardly to the ribs; and wherein the first portion of the elbow member comprises a recess formed therein having the first portion of the tilt mechanism disposed therein.

15. The umbrella assembly of claim 14, wherein an angle between the second portion of the elbow member and the canopy frame decreases as the umbrella assembly is opened and an angle between the first portion of the elbow member and the canopy frame is approximately 90 degrees when the umbrella assembly is open.

16. The umbrella assembly of claim 14, wherein the second portion of the tilt mechanism is enclosed within the first portion of the tilt mechanism.

17. An umbrella assembly comprising:

an upright pole;

a canopy frame coupled with and disposed laterally of the upright pole at least when the umbrella assembly is open; a tilt mechanism having a first portion extending between the upright pole and the canopy frame and a second portion configured to be actuated to cause the first portion to rotate about an axis extending transverse to the upright pole;

an elbow member having a first portion coupled to an end of the first portion of the tilt mechanism disposed away from the upright pole and a second portion rotatably coupled to the canopy frame; and a cantilevered beam having a first end disposed away from the upright pole and a second end disposed adjacent to the upright pole, wherein the canopy frame is coupled with and disposed laterally of the first end of the cantilevered beam and the first portion of the tilt mechanism extends through the cantilevered beam to a first end coupled with the elbow member;

wherein the first portion of the elbow member comprises a recess formed therein and the first end of the first portion of the tilt mechanism is disposed in the recess.

18. The umbrella assembly of claim 17, wherein the first end of the first portion of the tilt mechanism is configured to mate with the recess of the elbow member to directly apply a torque to the elbow member.

19. The umbrella assembly of claim 18, wherein the first portion of the tilt mechanism comprises a shaft with at least a flat side and the recess of the elbow member comprises a corresponding flat surface.

* * * * *

UNITED STATES PATENT AND TRADEMARK OFFICE

CERTIFICATE OF CORRECTION

PATENT NO. : 9,237,785 B2
APPLICATION NO. : 13/797156
DATED : January 19, 2016
INVENTOR(S) : Ma It is certified that error appears in the above-identified patent and that said Letters Patent is hereby corrected as shown below:

On the title page

Column 2 page 3, item 56 line 1, change "Centilever" to --Cantilever--.

In the specification

Column 3 line 26, Change "position;" to --position.--.

Column 5 line 2, After "shaft)" insert --.--.

In the claims

Column 11 line 60, Claim 12, change "an-axis" to --an axis--.

Column 11 line 66, Claim 13, change "the" to --wherein the--.

Signed and Sealed this
Nineteenth Day of July, 2016

Michelle K. Lee

Michelle K. Lee
*Director of the United States Patent and Trademark Office*